US011994118B2

(12) United States Patent
Jansen

(10) Patent No.: US 11,994,118 B2
(45) Date of Patent: May 28, 2024

(54) PULSATION DAMPING SYSTEM

(71) Applicant: MHWIRTH GMBH, Erkelenz (DE)

(72) Inventor: Roman Jansen, Wassenberg (DE)

(73) Assignee: MHWIRTH GMBH, Erkelenz (DE)

( * ) Notice: Subject to any disclaimer, the term of this patent is extended or adjusted under 35 U.S.C. 154(b) by 517 days.

(21) Appl. No.: 17/053,073

(22) PCT Filed: Apr. 15, 2019

(86) PCT No.: PCT/EP2019/059600

§ 371 (c)(1),
(2) Date: Nov. 5, 2020

(87) PCT Pub. No.: WO2019/214905

PCT Pub. Date: Nov. 14, 2019

(65) Prior Publication Data

US 2021/0231113 A1 Jul. 29, 2021

(30) Foreign Application Priority Data

May 7, 2018 (DE) ..... 10 2018 110 847.8
May 7, 2018 (DE) ..... 10 2018 110 848.6

(51) Int. Cl.
*F04B 11/00* (2006.01)
*F04B 43/073* (2006.01)
*F04B 53/10* (2006.01)

(52) U.S. Cl.
CPC ..... *F04B 11/0016* (2013.01); *F04B 11/0091* (2013.01); *F04B 43/073* (2013.01); *F04B 53/10* (2013.01)

(58) Field of Classification Search
CPC . F04B 11/005; F04B 11/0016; F04B 11/0091; F04B 53/002; F04B 53/10; F04B 43/06; F04B 43/067; F04B 43/073
USPC ..... 417/540
See application file for complete search history.

(56) References Cited

U.S. PATENT DOCUMENTS 1,627,257 A * 5/1927 Stevens ..... F04B 43/067 417/63
2,934,025 A * 4/1960 Wilson ..... F04B 11/0016 417/63
3,289,406 A * 12/1966 Panhard ..... B04C 5/02 60/464

(Continued)

FOREIGN PATENT DOCUMENTS

DE 651 698 A 10/1937
DE 1 528 392 A1 7/1970

(Continued)

*Primary Examiner* — Devon C Kramer
*Assistant Examiner* — Chirag Jariwala
(74) *Attorney, Agent, or Firm* — Norman B. Thot

(57) ABSTRACT

A pulsation damping system for reducing pressure oscillations in an inlet line and/or in an outlet line of a piston pump. The piston pump includes a pump chamber which is connected to the inlet line of the piston pump via a first fluid connection and to the outlet line of the piston pump via a second fluid connection to convey a conveyance fluid. The pulsating damping system includes a damping device. The pump chamber includes a damping fluid connection via which the pump chamber is fluidically connected to the damping device to damp the pressure oscillations.

4 Claims, 9 Drawing Sheets

(56) References Cited

U.S. PATENT DOCUMENTS

| | | | | | |
|---|---|---|---|---|---|
| 3,692,433 | A | * | 9/1972 | Finger | F04B 11/0016 417/382 |
| 3,838,941 | A | | 10/1974 | Roschupkin et al. | |
| 4,177,016 | A | | 12/1979 | Aude | |
| 4,459,089 | A | | 7/1984 | Vincent et al. | |
| 4,477,237 | A | | 10/1984 | Grable | |
| 5,165,869 | A | * | 11/1992 | Reynolds | F04B 43/009 417/388 |
| 6,068,448 | A | * | 5/2000 | Muratsubaki | F04B 3/00 417/536 |
| 6,086,336 | A | * | 7/2000 | Welschof | F04B 11/0016 91/487 |
| 6,193,329 | B1 | | 2/2001 | Kanauchi | |
| 2004/0208765 | A1 | | 10/2004 | Malmberg et al. | |
| 2010/0115932 | A1 | | 5/2010 | Kassel et al. | |
| 2015/0260178 | A1 | | 9/2015 | Giessbach | |
| 2017/0101986 | A1 | | 4/2017 | Horwath et al. | |

FOREIGN PATENT DOCUMENTS

| | | | |
|---|---|---|---|
| DE | 2 115 826 | A1 | 10/1971 |
| DE | 81 11 221 | U1 | 8/1981 |
| DE | 10 2010 024 813 | A1 | 12/2011 |
| DE | 10 2010 041 487 | A1 | 3/2012 |
| DE | 10 2012 109 634 | A1 | 4/2014 |
| EP | 0 679 832 | A1 | 11/1995 |
| FR | 2 638 812 | A1 | 5/1990 |
| WO | WO 98/49040 | A1 | 11/1998 |
| WO | WO 2018/091306 | A1 | 5/2018 |

* cited by examiner

PULSATION DAMPING SYSTEM

CROSS REFERENCE TO PRIOR APPLICATIONS

This application is a U.S. National Phase application under 35 U.S.C. § 371 of International Application No. PCT/EP2019/059600, filed on Apr. 15, 2019 and which claims benefit to German Patent Application No. 10 2018 110 848.6, filed on May 7, 2018, and to German Patent Application No. 10 2018 110 847.8, filed on May 7, 2018. The International Application was published in German on Nov. 14, 2019 as WO 2019/214905 A1 under PCT Article 21(2).

FIELD

The present invention relates to a pulsation damping system for reducing pressure oscillations in pipes on the inlet and/or outlet side, in particular in the intake and/or high-pressure area, of piston pumps, in particular for conveying fluids with solid contents, such as sludge feed pumps, with at least one piston pump having a pump chamber, wherein the pump chamber is fluidically connected to a pump inlet channel, also called an intake channel, via a first fluid connection, and to a pump outlet channel via a second fluid connection in order to convey a conveyance medium or fluid. The present invention also relates to a pulsation damping system for reducing pressure oscillations in inlet-side and/or outlet-side pipes, in particular in the intake and/or high-pressure area of piston pumps, with at least one pump inlet channel and pump outlet channel that can be fluidically connected to a pump chamber of a piston pump in order to convey a conveyance medium or conveyance fluid, wherein a first storage container is arranged in the pump inlet channel and/or in the pump outlet channel, in which container a fluid to be conveyed can be temporarily stored in a first area, also called a pressure chamber, and a gas volume, in particular a compressible gas volume, is arranged in a second area, also called a pressure chamber.

BACKGROUND

Such pulsation damping systems are known in numerous variants and are typically used in pipe systems in which pressure oscillations or pressure surges can arise, for example due to the operation of a pump, an actuator, or due to other flow influences. For example, during the operation of piston pumps, due to the oscillating movement of the pump pistons, irregular volume flows, as inherent to the functional principle, arise both in the intake tract and at the outlet of the pump. Such irregular volume flows lead to pressure pulsations, which have negative effects on the functionality of the pump and can lead to undesired oscillations in the adjacent pipe system. In the intake tract of the pump, these pulsations can cause cavitation, which on the one hand can lead to a reduction in the efficiency of the pump and on the other hand to damage to the pump.

Known pulsation dampers are usually arranged in inlet-side and/or outlet-side pipes of the pump and usually comprise a compensation or reservoir chamber that is filled with a compressible gas volume and is fluidically in operative connection with the pulsating fluid to be conveyed. Such dampers act in such a manner that a pressure increase is compensated by a compression of the gas volume located in the reservoir chamber. Since the gas has only a small pressure changes as a result of its high compressibility compared to the fluid, pressure pulsations due to the impressed volume flow pulsations can thus be reduced.

It should be clear that an inlet-side pipe means a pump inlet channel or an intake line, and an outlet-side pipe means a pump outlet channel or a high-pressure line, wherein the pump inlet channel is typically connected to a fluid source for taking in the conveyance fluid, and the pump outlet channel serves for the further transport of the fluid to be conveyed. In the pump inlet channel and the pump outlet channel, a non-return valve is typically respectively arranged between the aforementioned reservoir chamber and the pump chamber in order to convey the fluid by means of the piston pump. In this case, the pump can be formed in particular as a classic piston pump with, for example, a single pump chamber, or as a piston diaphragm pump with a pump chamber comprising a pump working chamber and a pump conveyance chamber. Furthermore, a plurality of pistons or piston pumps are typically used; these suck the fluid to be conveyed from a common intake line with a central reservoir and convey it on the high-pressure side into a common high-pressure line.

From EP 0 679 832 A1, for example, an embodiment of a damping system is known, in which, in order to reduce pressure pulsations in a pipe, a volume change area with a wall that is displaceable and thereby changeable for a pipe volume is provided.

Furthermore, the use of known pulsation dampers in the case of fluids with solid contents to be conveyed is possible only to a limited extent since the throttle resistors, compensation chambers, or other pressure-damping components usually connected to a main conveying line either tend to clog due to the constriction created or must be selected large enough to avoid clogging such that the damping effect decreases markedly. Furthermore, the solid contents contained in the fluid are often very abrasive so that a throttle point can wear quickly when such solids flow through, which in turn negatively affects the functionality of the damper.

SUMMARY

An aspect of the present invention is to provide a system for reducing pressure oscillations in inlet-side and/or outlet-side pipes of piston pumps, which improves at least one of the aforementioned disadvantages, and which in particular enables an effective and durable use in the field of pumps for conveying fluids with a particularly wide range of pressure fluctuations, and also with solid contents.

In an embodiment, the present invention provides a pulsation damping system for reducing pressure oscillations in at least one of an inlet line and in an outlet line of at least one piston pump. The at least one piston pump comprises a pump chamber which is connected to the inlet line of the at least one piston pump via a first fluid connection and to the outlet line of the at least one piston pump via a second fluid connection so as to convey a conveyance fluid. The pulsating damping system comprises a damping device. The pump chamber comprises at least one damping fluid connection via which the pump chamber is fluidically connected to the damping device so as to damp the pressure oscillations.

BRIEF DESCRIPTION OF THE DRAWINGS

The present invention is described in greater detail below on the basis of embodiments and of the drawings in which.

DETAILED DESCRIPTION

Figure 1:
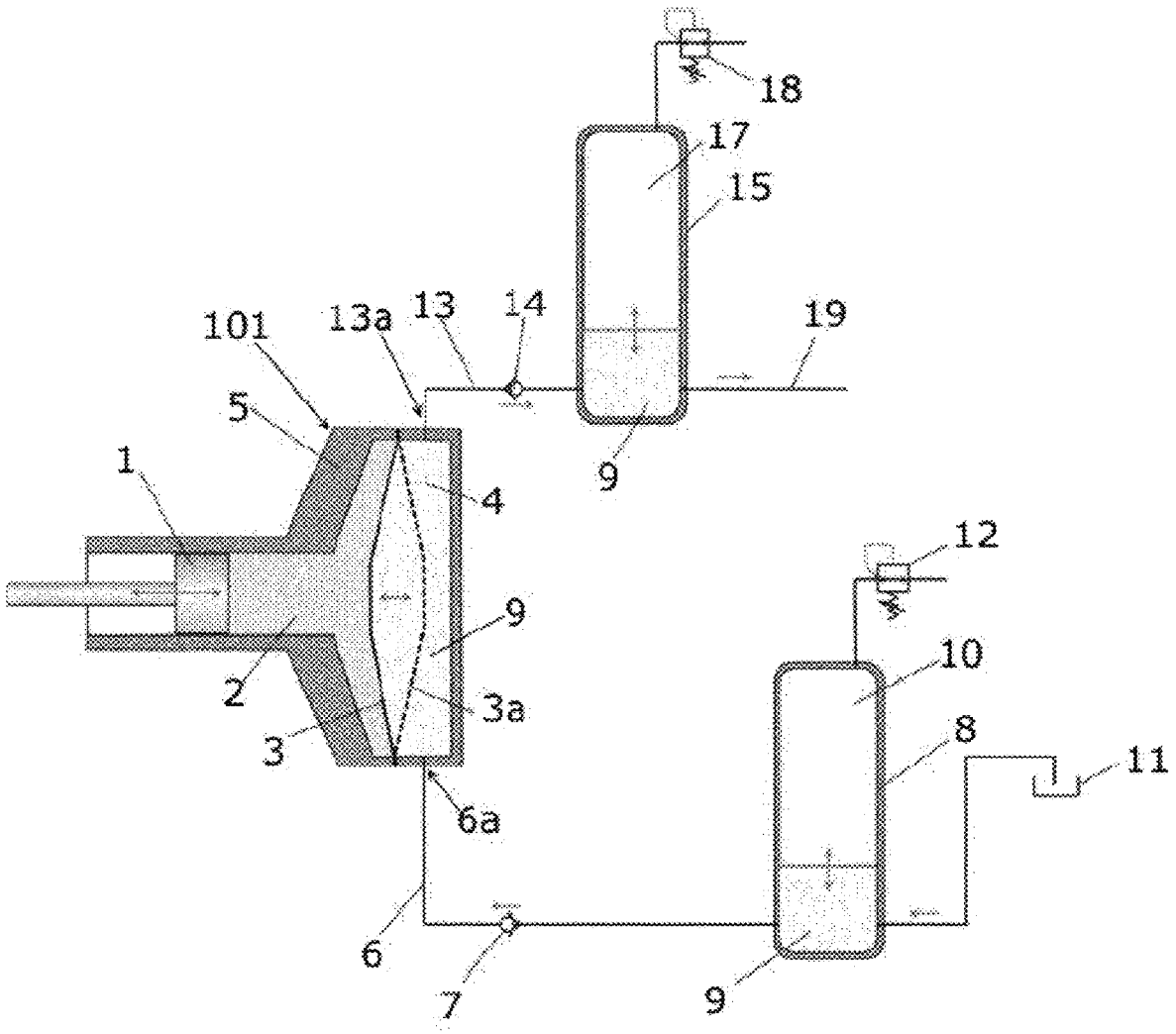
Fig. 1 (Prior Art)
FIG. 1 shows a piston diaphragm pump known from the prior art.

The pump chamber of a pulsation damping system according to the present invention has at least one additional fluid connection, also called a damping fluid connection, with which the pump chamber, in particular the fluid located therein, is in each case fluidically connected to a damping device for damping pressure oscillations. The damping can be effected in particular by a time-regulated and/or quantity-regulated supply or discharge of a fluid located in the pump chamber in the direction toward or away from the damping device. In addition, a pressure surge arising in the pump chamber and/or the adjacent inlet-side and/or outlet-side pipes can be "intercepted" by means of the damping device, for example by a change in volume. Thus, in particular at high pump frequencies, the acceleration effects caused by the oscillating movement of the piston and exerted on the fluid medium, which can lead to relatively high acceleration forces in the pump chamber and the adjacent inlet-side and/or outlet-side pipes and consequently to pressure pulsations, can thus be reduced and pressure surges can thus be reduced in a particularly simple manner. The fluid flowing between the pump chamber and the damping device can advantageously be formed as an incompressible blocking fluid, such as a hydraulic oil, in particular a pump working medium, or alternatively be the fluid medium to be conveyed. Based on such embodiment, in particular due to, for example, a damping fluid acting on the pump chamber independently of the fluid to be conveyed, the present pulsation damping system is particularly suitable for use in pipe systems for conveying fluids with solid contents.

At least one throttle valve can, for example, be arranged in a pipe arranged between the pump chamber and the damping device. The throttle valve can in particular be arranged between the pump chamber and a pressure chamber fluidically connected to the pump chamber, for example a volume change device or a reservoir. As a result, at least a part of the pulsation energy can be converted into heat and the magnitude of the pressure pulsations can thus be reduced particularly effectively and advantageously. In particular, a pressure pulse of a fluid, which for example is at least partially located in the pump chamber and flows through the damping fluid connection in the direction toward or away from the damping device due to a very high or very low pressure, can be converted into heat when flowing through the throttle valve so that in particular pressure pulsations can be reduced thereby. The throttle valve can consequently also be regarded as a part of the damping device. Alternatively, the throttle can in principle also be arranged in an adjacent or downstream pipe system which, although not directly fluidically connected to the pump chamber, is in operative connection with the pump with respect to the pressure prevailing in the pump chamber, for example by means of a device for pressure transfer from the fluid located in the pump chamber to a separate second fluid.

The damping device can, for example, have a volume change device, also called a volume compensation device, for changing the volume of at least one pressure chamber fluidically connected to the pump chamber. In particular, a fluid which is located in the pump chamber and which is exposed, for example, to an elevated pressure can thereby be guided or conveyed in a controllable manner through the damping fluid connection in the direction toward or away from the damping device. Such control of the fluid flow can be effected, for example, by increasing a pressure chamber downstream of the damping fluid connection for releasing an inflow of the fluid from the pump chamber into the pressure chamber or by reducing the pressure chamber for returning or outflowing the fluid from the pressure chamber into the pump chamber. In the case of the flowing through of the throttle which can, for example, be arranged in the pipe between the pump chamber and the pressure chamber, a pressure pulse that arises can be converted into heat, and a pressure pulsation can thereby be reduced in a particularly effective and controllable manner. It should be clear that the term "controllable" is to be understood in particular to mean that a flow through the throttle and a pressure reduction caused thereby can take place in a time-defined and quantity-defined, for example, predictably, for example, automatically.

The volume change device can, for example, have a displacement body for changing the volume of the at least one pressure chamber, which displacement body is formed in particular as a displaceable wall, displaceable piston, or displaceable diaphragm. In order to control or regulate the change in volume of the pressure chamber, the displacement body can be acted upon by a counter-pressure in relation to the fluid pressure applied to the pressure chamber side, for example via a spring-elastic element. The displacement body can, for example, be formed as a piston, in particular a separating piston, or as a diaphragm of a self-contained system, such as a piston-cylinder unit. In such an embodiment, the counter-pressure acting on the piston or the diaphragm can be effected, for example, by a correspondingly arranged and pressurized second pressure chamber. The displacement of the displacement body can thereby be controlled in a particularly advantageous manner, in particular actively.

The volume change device can, for example, have a first pressure chamber fluidically connected to the pump chamber and a second pressure chamber fluidically separated therefrom by means of the displacement body and in operative connection thereto. For this purpose, the second pressure chamber is advantageously filled with a gas volume. By displacing or shifting the displacement body, the respective volumes of the first and second pressure chambers can be changed in relation to each other in a relatively simple manner; in particular, if the first pressure chamber volume is increased, the second pressure chamber volume can be reduced, and if the first pressure chamber volume is reduced, the second pressure chamber volume can be increased. As a result, a flow of the fluid located in the pump chamber through the damping fluid connection in the direction toward or away from the damping device can be particularly advantageously controlled, and a particularly efficient damping, in particular in the area of the throttle point, can be effected.

In order to regulate a gas pressure prevailing in the second pressure chamber, the second pressure chamber can, for example, be connected fluidically directly and/or indirectly via a control valve to a separate gas source. This enables a particularly independent and simple actuation of the counter-pressure applied to the displacement body. The gas pressure prevailing in the second pressure chamber can be regulated, for example, by means of the aforementioned separate or external pressure or gas source and the control valve used for regulation, wherein the control valve can be controlled via at least one pressure sensor arranged in the pump inlet channel and/or the pump outlet channel and a PID regulation (proportional integral differential regulation) suitable for this purpose. With the arrangement of a plurality of volume change devices, the control valve of a volume change device arranged on the pump inlet side can, for example, be controlled as a function of a pressure prevailing in the pump inlet channel, and/or the control valve of a volume change device arranged on the pump outlet side can be controlled as a function of a pressure prevailing in the pump outlet channel. Alternatively, the respective control valve can also be controlled as a function of a pressure prevailing in the pump chamber, wherein, for this purpose, the pressure sensor is advantageously arranged in the area of the pump chamber.

In order to regulate a gas pressure prevailing in the second pressure chamber, the second pressure chamber can, for example, be operatively connected directly or indirectly to the pressure prevailing in the pump inlet channel and/or in the pump outlet channel. For example, the second pressure chamber can be fluidically connected to a reservoir, such as a compressed-air vessel, fluidically connected to the pump inlet channel or to the pump outlet channel. As a result, the pressure source or pressure measure for the fluid of the second pressure chamber can be the pressure prevailing in the pump inlet channel and/or in the pump outlet channel, wherein the fluid of the second pressure chamber can, for example, be fluidically separated, for example by means of a diaphragm, from the conveyance fluid in the pump inlet channel or the pump outlet channel.

The damping device can, for example, have a reservoir which has a conveyance fluid inlet and a conveyance fluid outlet and is arranged in the pump inlet channel and/or in the pump outlet channel, in particular on a fluid side, facing away from the piston pump, of a non-return valve arranged in the respective channel, wherein the conveyance fluid is arranged in a lower area of the reservoir and a gas volume that is pressurized, that is, under pressure, is arranged in an upper area of the reservoir. For this purpose, the reservoir can, for example, be formed as a volume and/or pressure storage container, in particular with the formation or taking up of a volume in the reservoir, in which storage container the conveyance fluid can advantageously be temporarily stored for conveyance. In particular in the case of fluids to be conveyed which have solid particles, this enables a reliable and efficient pressure transfer from the conveyance fluid to the gas volume, in particular for pressure compensation purposes. The reservoir can, for example, be formed as a pressure vessel. The gas volume can, for example, be operatively connected directly or indirectly to the fluid located in the second pressure chamber. This enables, depending on the direction of movement of the piston of the piston pump, an automatic control of the displacement body in particular by means of a pressure transfer from the pump inlet channel and/or the pump outlet channel to the second pressure chamber. For adjusting or regulating the gas pressure prevailing in the reservoir, the reservoir can be fluidically connected directly and/or indirectly via a control valve at least temporarily to a separate gas source.

The gas volume of the reservoir can, for example, be fluidically connected to the second pressure chamber of the volume change device via a pressure line. The pressure prevailing in the gas volume of the reservoir can thereby act directly on the displacement body. Such an embodiment is particularly advantageous for conveyance fluids with solid particles and in particular enables a reliable and automatic displacement of the displacement body, and thereby ultimately a reduction of pulsation pressures. For example, a pressure, applied on the pump inlet side or the pump outlet side, of the medium to be conveyed, in particular of a fluid mixed with solids, can be transferred in a particularly simple and reliable manner to a fluid, in particular a gaseous fluid, fluidically connected to the second pressure chamber. This enables, depending on the direction of movement of the piston of the piston pump, an automatic and direct control of the displacement body by means of the pressure in the second pressure chamber and consequently an inflow or outflow of the fluid of the pump chamber in the direction to or from the damping device, while simultaneously flowing through a throttle point and thereby converting a pressure pulse into heat, thus ultimately enabling an automatic damping of pressure pulsations.

The piston pump can, for example, be formed as a diaphragm piston pump with a pump working chamber and a pump conveyance chamber fluidically separated therefrom and in operative connection thereto, wherein the first and second conveyance fluid connections are arranged at the pump conveyance chamber and the at least one damping fluid connection is arranged at the pump working chamber. In this case, a pressure medium can be provided in the pump working chamber, which medium is fluidically connected to the first pressure chamber of the volume change device via the damping fluid connection. The pump working chamber is arranged on the piston side, in particular with respect to the diaphragm of the pump, and the pump conveyance chamber is arranged on the side of the diaphragm facing away from the piston. Such fluidic separation of the conveyance fluid from a pressure medium makes a particularly efficient and reliable reduction of pressure pulsations possible, particularly in the case of conveyance fluids with solid particles. In an alternative embodiment, in particular with a conventional piston pump, the pump working chamber and the pump conveyance chamber form a common pump chamber.

Furthermore, with a pulsation damping system according to the present invention for damping pressure oscillations in a pipe section of the pump inlet channel and/or of the pump outlet channel fluidically connecting the first storage container and the pump chamber, a, for example, separately formed second storage container, or also referred to as compensation container, compressed-air vessel, or volume change device, is additionally arranged. Based on such embodiment, the present pulsation damping system is in particular suitable for use in pipe systems of piston pumps, in which particularly high amplitudes and/or high frequencies of pressure fluctuations and pressure pulses arise. In particular, at high pump frequencies, the acceleration effects caused by the oscillating movement of the piston and exerted on the fluid medium, which can lead to relatively high acceleration and pressure forces in the pump chamber and the adjacent inlet-side and/or outlet-side pipes, can be reduced, and recurring pressure surges can thus be reduced in a particularly simple and effective manner. The damping can be effected in particular by a time-regulated and/or quantity-regulated supply or discharge of a conveyance fluid located in the pump inlet channel, in particular in the pipe section of the pump inlet channel arranged advantageously immediately upstream of the pump chamber inlet connection and/or in the pump outlet channel, in particular in the pipe section of the pump outlet channel arranged advantageously immediately downstream of the pump chamber outlet connection, in the direction toward or away from the respective second storage container. This control of the fluid flow can be effected, for example, by releasing an inflow of the fluid from the pump inlet channel or pump outlet channel into the second storage container or an outflow of the fluid from the second storage container into the pump inlet channel or pump outlet channel. The pressure surge arising in the inlet-side and/or outlet-side pipes can in this case be "intercepted," inter alia, in the second storage container, for example by a change in volume.

It should be clear that the term "pump inlet channel" refers to a pipe on the pump inlet side or a suction pipe, and the term "pump outlet channel" refers to a pipe on the pump outlet side or a high-pressure pipe, wherein the pump inlet channel is typically connected to a fluid source for taking in the conveyance fluid and the pump outlet channel serves for the further transport of the fluid to be conveyed. In this case, the pump can be formed in particular as a classic piston pump with, for example, a single pump chamber, or as a piston diaphragm pump with a pump chamber comprising a pump working chamber and a pump conveyance chamber. Furthermore, a plurality of pistons or piston pumps are typically used; these suck the fluid to be conveyed from a common intake line with a central reservoir and convey it on the high-pressure side into a common high-pressure line.

The second storage container can, for example, be filled in a first area with the conveyance fluid to be conveyed and in a second area with a compressible gas volume. The conveyance fluid can, for example, be arranged in each case in the second storage container in a lower area, and a gas volume that is pressurized, that is, under pressure, is arranged in an upper area. For this purpose, the second storage container can, for example, be formed as a volume and/or pressure storage container, in particular with the formation or taking up of a volume in the reservoir, in which storage container the conveyance fluid can advantageously be temporarily stored for conveyance. In particular in the case of fluids to be conveyed which have solid particles, this enables a reliable and efficient pressure transfer from the conveyance fluid to the gas volume, in particular for pressure compensation purposes, and a reliable and in particular residue-free supply or discharge of the conveyance fluid into and out of the storage container. Deposits of solid particles can thereby in particular be prevented. The second storage container can, for example, be formed as a pressure vessel. The gas volume located in the second area, which can, for example, be arranged at the top, can, for example, be operatively connected directly or indirectly to the fluid which can, for example, be located in the lower area. For adjusting or regulating the gas pressure prevailing in the storage container, the storage container can be connected directly and/or indirectly via a control valve at least temporarily to a separate gas source. In this case, no additional component, such as a partition wall, can be provided between the fluid to be conveyed and the gas volume, but only one fluid level can be formed. By displacing or shifting the fluid level within the storage container, the respective volumes of the first and second areas can be changed in relation to each other; in particular, if the first area is increased, the second area can be reduced and if the first area is reduced, the second area can be increased. Particularly efficient damping can be achieved by the inflow and outflow of the fluid in the pump inlet or pump outlet channel into or out of the second storage container. This flow can, for example, be controllable, for example, by releasing an inflow or an outflow of the fluid from the pump inlet channel or pump outlet channel into or out of the second storage container.

The second storage container, in particular the first area of the second storage container, can, for example, be connected via a branch pipe to the pipe section of the pump inlet channel or of the pump outlet channel, and a throttle valve is arranged in the branch pipe. In particular, the inlet-side second storage container, or the first area of this second storage container, can be connected via a first branch pipe to the pipe section of the pump inlet channel, and the outlet-side second storage container, or the first area of this second storage container can be connected via a second branch pipe to the pipe section of the pump outlet channel, wherein a throttle valve is arranged in each of the branch pipes. In the flow through the throttle which can, for example, be arranged in the pipe between the pump chamber and the respective first area of the second storage container, at least a portion of the pulsation energy can be converted into heat and the magnitude of the pressure pulsations can thus be reduced in a particularly effective and controllable manner. It should be clear that the term "controllable" is to be understood in particular to mean that a flow through the throttle and a pressure reduction caused thereby can take place in a time-defined and quantity-defined, for example, predictably, for example, automatically.

The first storage container arranged in the pump inlet channel can, for example, be fluidically connected, directly or indirectly, via a fluid inlet to a conveyance fluid source and via a fluid outlet to the second storage container and/or the first storage container arranged in the pump outlet channel is fluidically connected, directly or indirectly, via a fluid inlet to the second storage container and via a fluid outlet to an outlet line. As a result, the second storage container can be arranged in the pump inlet channel downstream of the first storage container and in the pump outlet channel upstream of the first storage container.

In order to regulate a gas pressure, the gas volume of the second storage container and/or the gas volume of the first storage container can, for example, be directly and/or indirectly connected fluidically via a control valve to a separate gas source. This enables a particularly independent and simple control of the counter-pressure respectively applied in the second area of the storage container. The regulation can be carried out, for example, by means of a control valve, wherein the control valve can be controlled, for example, via at least one pressure sensor arranged in the pump inlet channel and/or the pump outlet channel and a PID regulation (proportional integral differential regulation), suitable for this purpose, for controlling the control valves. With the arrangement of a plurality of storage containers, for example, the control valve of a storage container arranged on the pump inlet side can be controlled as a function of a pressure prevailing in the pump inlet channel and/or the control valve of a storage container arranged on the pump outlet side can be controlled as a function of a pressure prevailing in the pump outlet channel. Alternatively, the respective control valve can also be controlled as a function of a pressure prevailing in the pump chamber, wherein, for this purpose, the pressure sensor is advantageously arranged in the area of the pump chamber.

The gas volume of the second storage container can, for example, be fluidically connected to the gas volume of the first storage container, in particular via a separate auxiliary pipe, such as a gas pressure line. As a result, the two second areas of the storage containers can be operatively connected so that the gas pressure prevailing in the second area of the respectively other storage container can serve as a pressure source or pressure measure for the fluid of the second area of the one storage container. Furthermore, automatic damping of pressure pulsations is thereby made possible.

A non-return valve and the second storage container, or the branch of the branch pipe leading into the second storage container, can, for example, be arranged in the pipe section arranged between the pump chamber and the first storage container. The pump can operate particularly efficiently as a result.

The second storage container on the pump inlet side can, for example, be fluidically connected to the pump inlet channel in the flow direction downstream of the first storage container on the pump inlet side and upstream of the pump chamber, in particular upstream of a non-return valve, and/or the second storage container on the pump outlet side is fluidically connected to the pump outlet channel downstream of the pump chamber, in particular downstream of a non-return valve, and upstream of the first storage container on the pump outlet side. In particular, the second storage container is arranged on a fluid side, facing away from the piston pump, of the non-return valve arranged in the respective pump channel. This enables particularly effective pressure pulsation damping.

In principle, fluidic separation of the first area and the second area can take place in the first and second storage containers by means of the different densities of the fluid located in the first area and of the gas present in the second area. In this embodiment, no separating means is therefore provided between the first area and the second area. In this case, the fill level height in the respective storage container can be regulated via a regulation of the gas pressure. Such an embodiment enables in particular a low-weight, maintenance-free, and cost-effectively producible storage container. In certain embodiments, however, it may be advantageous that, for the fluidic separation of the first area and the second area in the first storage container and/or in the second storage container, a respective displacement body is arranged between the fluid and the gas volume, which displacement body is formed in particular as a displaceable wall, displaceable piston, or displaceable diaphragm. As a result, the pressure prevailing in the gas volume of the respective storage container can act directly on the displacement body, in particular as a counterforce to a force applied by the fluid. The displacement body can, for example, be formed as a flexible diaphragm. As a result, the displacement of the displacement body can be effected in a particularly simple manner. The storage container can thus in particular respectively have a first pressure chamber filled with the fluid and a second pressure chamber fluidically separated therefrom by means of the displacement body, operatively connected thereto, and, for example, filled with the gas. Such an embodiment is particularly advantageous for conveyance fluids with solid particles and enables reliable and low-maintenance pulsation damping, particularly in the case of such fluids. Thus, a pressure, applied on the pump inlet side or on the pump outlet side, of the medium to be conveyed, in particular of a fluid mixed with solids, can be transferred in a particularly simple and reliable manner to the second area of the storage container, in particular to a gaseous fluid. In this case, the displacement body can, for example, be displaced in the direction of the first or the second area. By displacing or shifting the displacement body separating the areas, the respective volumes of the first and the second area can be changed in relation to each other in a relatively simple manner; in particular, if the first area or pressure chamber volume is increased, the second area or the second pressure chamber volume can be reduced and if the first area is reduced, the second area can be increased. As a result, a flow of the fluid located in the pump inlet channel or pump outlet channel into or out of the second storage container can be controlled particularly advantageously, and a particularly efficient damping can be effected. In order to control or regulate the change in volume, the displacement body can be acted upon by a counter-pressure in relation to the pressure applied on the conveyance fluid side, for example via a spring-elastic element. The displacement body can, for example, be formed as a piston, in particular a separating piston, of a self-contained system, such as a piston-cylinder unit. In such an embodiment, the counter-pressure acting on the piston or the diaphragm can be effected, for example, by a medium located in the correspondingly arranged and pressurized second pressure chamber.

The piston pump can, for example, be formed as a piston diaphragm pump having a pump working chamber and a pump conveyance chamber fluidically separated therefrom and operatively connected thereto. The pump working chamber is arranged on the piston side, in particular with respect to the diaphragm of the pump, and the pump conveyance chamber is arranged on the side of the diaphragm facing away from the piston. Such fluidic separation of the conveyance fluid from a pressure medium makes a particularly efficient and reliable reduction of pressure pulsations possible, particularly in the case of conveyance fluids with solid particles. In an alternative embodiment, in particular with a conventional piston pump, the pump working chamber and the pump conveyance chamber form a common pump chamber.

Exemplary embodiments of the present invention are explained in greater detail below on the basis of the drawings.

FIG. 1 shows the basic structure of a piston diaphragm pump 101 known from the prior art with the pipes 6, 13 connected thereto, along with the temporary storage containers 8, 15, also called reservoirs, which are advantageous therein for conveying a delivery need.

The oscillating movement of the piston 1 is transferred to a pressure medium 2*a* located in a first pressure chamber 2 formed as a pump working chamber. This pressure medium 2*a* is operatively connected via a flexible diaphragm 3/3*a* to the second pressure chamber 4, in the present case formed as a pump conveyance chamber, with respect to a pressure transfer. Both pressure chambers 2, 4 are surrounded by a pressure-resistant housing 5. In particular, the medium 9 to be conveyed is located in the pump conveyance chamber 4; it can enter the pump conveyance chamber 4 via a fluid inlet 6*a* and can exit the pump conveyance chamber 4 through a fluid outlet 13*a*. In particular, the medium 9 to be conveyed can be drawn into the pump conveyance chamber 4 through the fluid inlet 6*a* from an inlet line 6, in which a suction valve 7 formed as a non-return valve is located. In the arrangement from the prior art presented here, the inlet line 6 of the pump 101 additionally contains a reservoir 8, also called a pressure vessel, which is partly filled with the medium 9, i.e., a fluid, to be conveyed, and in the upper part of which there is a gas 10 under pressure, for example compressed air. In this case, the reservoir 8 is connected to a source 11, which has an increased geodetic height relative to the pump 101 in order to thus be able to provide the required suction pressure. Alternatively, the reservoir can also be acted upon by so-called "feed pumps," not shown here, which then generate the necessary suction pressure in the inlet line 6. In this case, the fill level in the reservoir 8 is regulated by the pressure of the gas 10. By measuring the fill level height in the reservoir 8, the pressure of the gas 10 can be varied, in particular via a control valve 12, in such a manner that a predetermined fill level height in the reservoir 8 is regulated as precisely as possible. For adjusting or regulating the gas pressure prevailing in the reservoir 8, the reservoir 8 is connected to a gas source via a pneumatic line arranged in the area of the volume of the gas 10 and via the control valve 12.

The pump conveyance chamber 4 of the pump 101 is connected to an additional reservoir 15 via an outlet line 13, in which a pressure valve 14 formed as a non-return valve is located. Analogously to the suction side of the pump 101, in particular to the reservoir 8 arranged thereon, the medium 9 to be pumped is likewise located in the lower area of the outlet-side reservoir 15, while a gas or air volume 17 that is under pressure is located thereabove. Here as well, the fill level of the reservoir 15 can be regulated via a control valve 18 that can be fluidically connected to the air volume 17 and also a gas source that is connected thereto and is not shown in greater detail. The volume flow generated by the pump 101 can then be supplied to the intended application via a discharge line 19.

The functionality of such a pump can be described as follows: During the suction phase of the piston pump 101 shown, the piston 1 moves to the left from the rightmost position shown in FIG. 1, resulting in a drop in pressure in the pump working chamber 2. This pressure is transferred by the flexible diaphragm 3/3*a*, which is located at the beginning of the suction phase in the position 3*a*, to the pump conveyance chamber 4, and thus to the medium 9 to be conveyed. If the pressure in the two pressure chambers 2 and 4 of the pump falls below the pressure prevailing in the reservoir 8, the suction valve 7 automatically opens and the medium 9 to be conveyed flows from the reservoir 8 into the pump conveyance chamber 4.

Once the piston 1 has reached the leftmost position shown in FIG. 1, it subsequently moves back to the right again. This results in a compression of the two fluid pressure chambers 2 and 4. This pressure increase causes the suction valve 7 to close and no further medium 9 to be sucked in. If the piston 1 now moves further to the right, the pressure in the two fluid chambers 2, 4 continues to rise until the pressure prevailing in the reservoir 15 is exceeded. As a result, the pressure valve 14 opens and the pump 101 conveys the medium 9 from the pump conveyance chamber 4 into the reservoir 15 until the piston 1 has again reached the rightmost position, and the process repeats.

The oscillating movement of the piston 1 exerts acceleration effects on the fluid medium 9 to be conveyed, which can lead to pulsations in the pressure chambers 2 and 4, the adjacent inlet line 6, and the outlet line 13. In order to reduce these pulsations, the pulsation damper system 100 according to the present invention is presented below, by means of which, above all, the pulsations that propagate when the medium 9 is sucked in can be reduced.

It should be clear that the embodiments of a respective pump with only one piston described here arise in practice only relatively infrequently, and in the present case are only intended to show the principle of operation of this type of pumps. Typically, pumps with a plurality of pistons are used; these draw in from a common intake line with a central reservoir and again convey into a common conveying line. The principles for position damping presented here can therefore be applied to pumps having any desired number of pistons.

Figure 2:
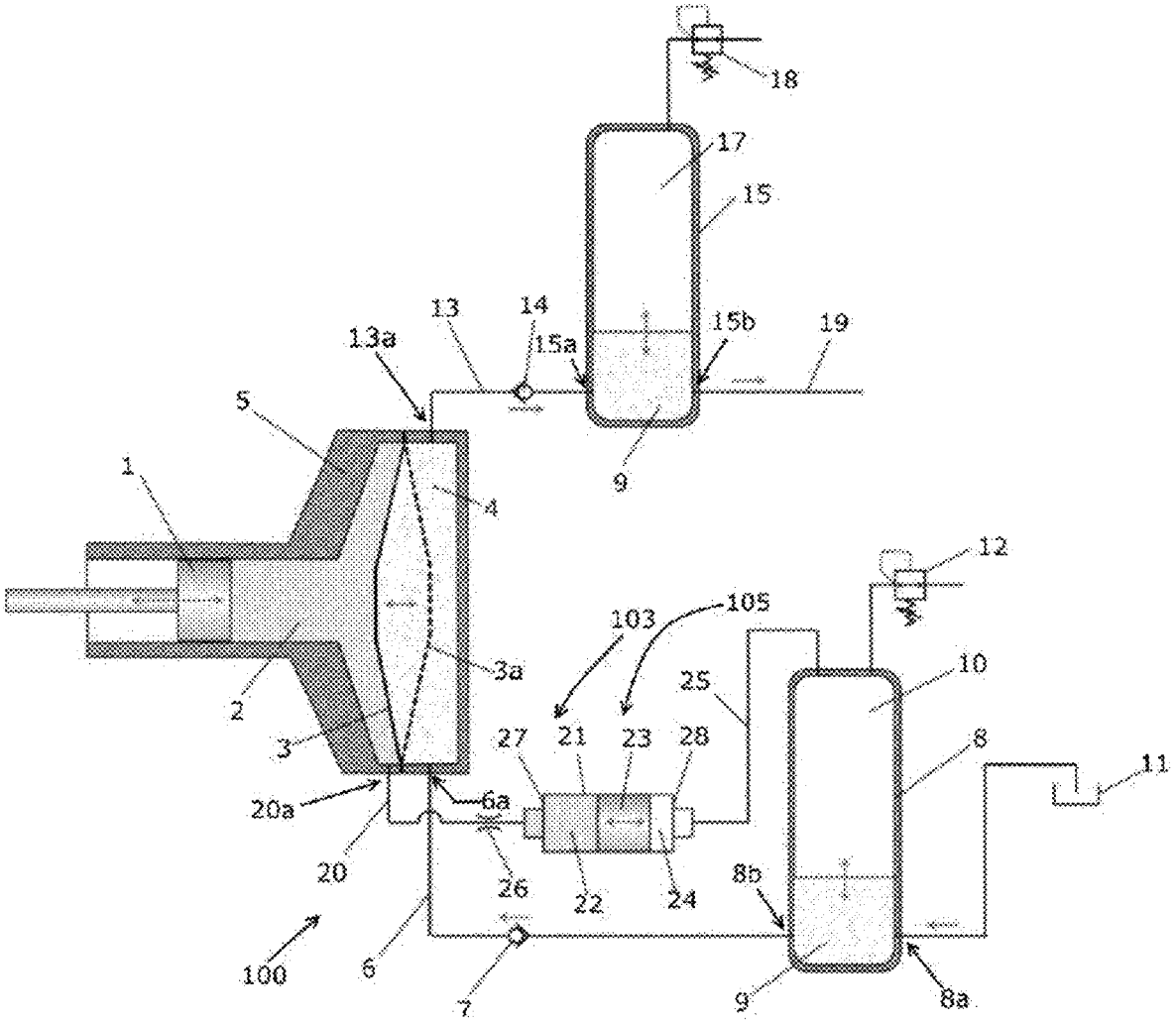
FIG. 2 shows a first embodiment of a pulsation damping system according to the present invention on a piston diaphragm pump.

FIG. 2 shows a first embodiment of the pulsation damping system 100 according to the present invention. This embodiment additionally provides, for example, a damping device 103 on the typical structure of a piston diaphragm pump system shown in FIG. 1. The damping device 103 in the present case comprises in particular a volume change device 105 formed as a piston-cylinder unit, also called a volume displacement unit. The volume change device 105 has a cylinder 21 with a first pressure chamber 22 arranged therein, connected to the pump working chamber 2 via a damping fluid connection 20*a* and a hydraulic connection line 20, along with a second pressure chamber 24 fluidically separated from the first pressure chamber 22 by means of a separating piston 23.

Due to this arrangement, in particular a portion of the pressure medium contained in the pump working chamber 2, in particular a hydraulic oil, can flow into or out of the first pressure chamber 22 of the cylinder 21. The second pressure chamber 24 is connected via a pressure line 25 to the volume of the gas 10 of the reservoir 8 arranged on the inlet side so that an average pressure corresponding to the average pressure in the reservoir 8 is established in the second pressure chamber 24.

In order to dampen the pulsations in the pump chambers 2 and 4 and the adjacent inlet line 6 and outlet line 13, a throttle point/throttle valve 26 is introduced into the hydraulic connection line 20. If a pressure increase due to pulsations in the pump chamber 2 arises, this leads to a volume flow from the pump working chamber 2 into the first pressure chamber 22 if the separating piston 23 is not in its end position (i.e., second stop 28), which is to the right in FIG. 2. As the throttle point 26 is flowed through, a portion of the pulsation energy is converted into heat and thus reduces the magnitude of the pressure pulsations. If a reduction of the pressure in the pump working chamber 2 arises afterwards, the pressure in the gas-filled second pressure chamber 24 leads to a displacement of the separating piston 23 and consequently to a volume flow of the pressure medium 2*a* from the first pressure chamber 22 into the pump working chamber 2, wherein in turn hydraulic energy is converted into heat at the throttle point 26 and the pulsations are thus further reduced.

The system can thus permanently convert pulsation energy into heat during the suction phase as long as the movement of the separating piston 23 is not prevented by reaching one of the end stops or cylinder stops 27 or 28.

If the compression described above arises in the pump working chamber 2 after the end of the suction phase, the separating piston 23 is moved as a result to the right again in FIG. 2 until the separating piston 23 is stopped by the second stop 28. Only now can the additional pressure increase take place and the medium 9 to be pumped can be conveyed via the outlet line 13 into the reservoir. During this discharge phase, the pressure in the pump chambers 2 and 4 is typically so high that the separating piston 23 remains permanently at the second stop 28, which is at the right in FIG. 2.

If the pump piston 1 now moves again to the left in FIG. 2, decompression occurs in pump chambers 2 and 4, the pressure valve 14 closes again and if the pressure of the medium 9 in the reservoir 8 is fallen below, the suction valve 7 opens and the medium 9 flows into the pump conveyance chamber 4. Since the pressure of the gas 10 in the pressure chamber is approximately equal to the pressure of the medium 9 located in the reservoir 8, a pressure difference also arises between the second pressure chamber 24 and the first pressure chamber 22 of the volume change device 105. This pressure difference now accelerates the separating piston 23 again in the direction of the first stop 27 so that, now, the separating piston 23 oscillates freely again due to the pulsations in the pump working chamber 2, and the throttle point 26 can reduce the pulsations.

Figure 3:
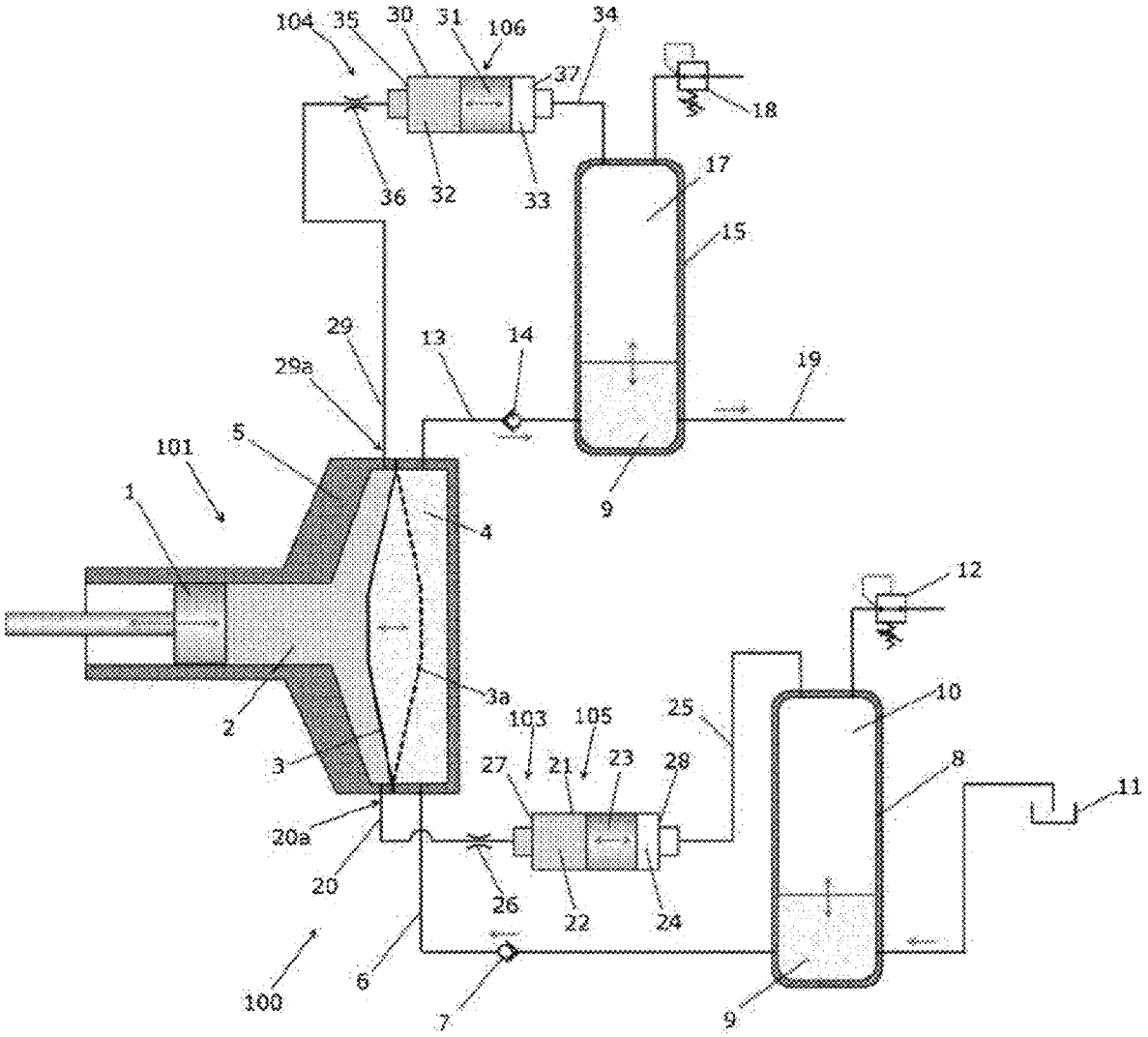
FIG. 3 shows an extended variant of the pulsation damping system of FIG. 2 as a second embodiment.

With the arrangement shown in FIG. 3, the pulsation damping system 100 according to FIG. 2 is additionally extended by a damping device 104 on the discharge side of the pump 101. Analogously to damping the pulsations during the suction phase, such a damping device 103 can also be used for the discharge side of the pump 101. In this case, the pump working chamber 2 is fluidically connected to an additional volume change device 106 via a pressure line in hydraulic connection line 29. In principle, the volume change device 106 is structured identically to the volume change device 105.

The volume change device 106 in turn has a cylinder 30 with a first pressure chamber 32 arranged therein, connected to the pump working chamber 2 via a damping fluid connection 29*a* and a hydraulic connection line 29, and a second pressure chamber 33 fluidically separated from the first pressure chamber 32 by means of a separating piston 31.

The first pressure chamber 32 is filled with the pressure medium 2*a*, while the second pressure chamber is filled with gas or air. This gas or the second pressure chamber 33 is connected via a pressure line 34 to the gas volume 17 of the reservoir 15 on the discharge side of the pump 101. During the suction phase of the pump 101, such low pressures prevail in the pump chamber 2, 4 that the excess pressure in the gas volume 17 moves the separating piston 31 as far as a first stop 35 and the latter remains there until the compression phase starts. When the opening pressure of the pressure valve 14 is exceeded, it is opened and a pressure increase is generated at the same time in the first pressure chamber 32, as a result of which a movement of the separating piston 31 is effected to the right in the direction of the second stop 37 in FIG. 3. The pulsations that now start in the fluid as the pressure medium 2*a* or in particular in the pump chambers 2 and 4 and in the inlet line 6 and outlet line 13 lead to an oscillating movement of the separating piston 31, wherein energy is extracted from the pressure pulsations by the associated flow through the throttle point 36 and converted into heat.

Figure 4:
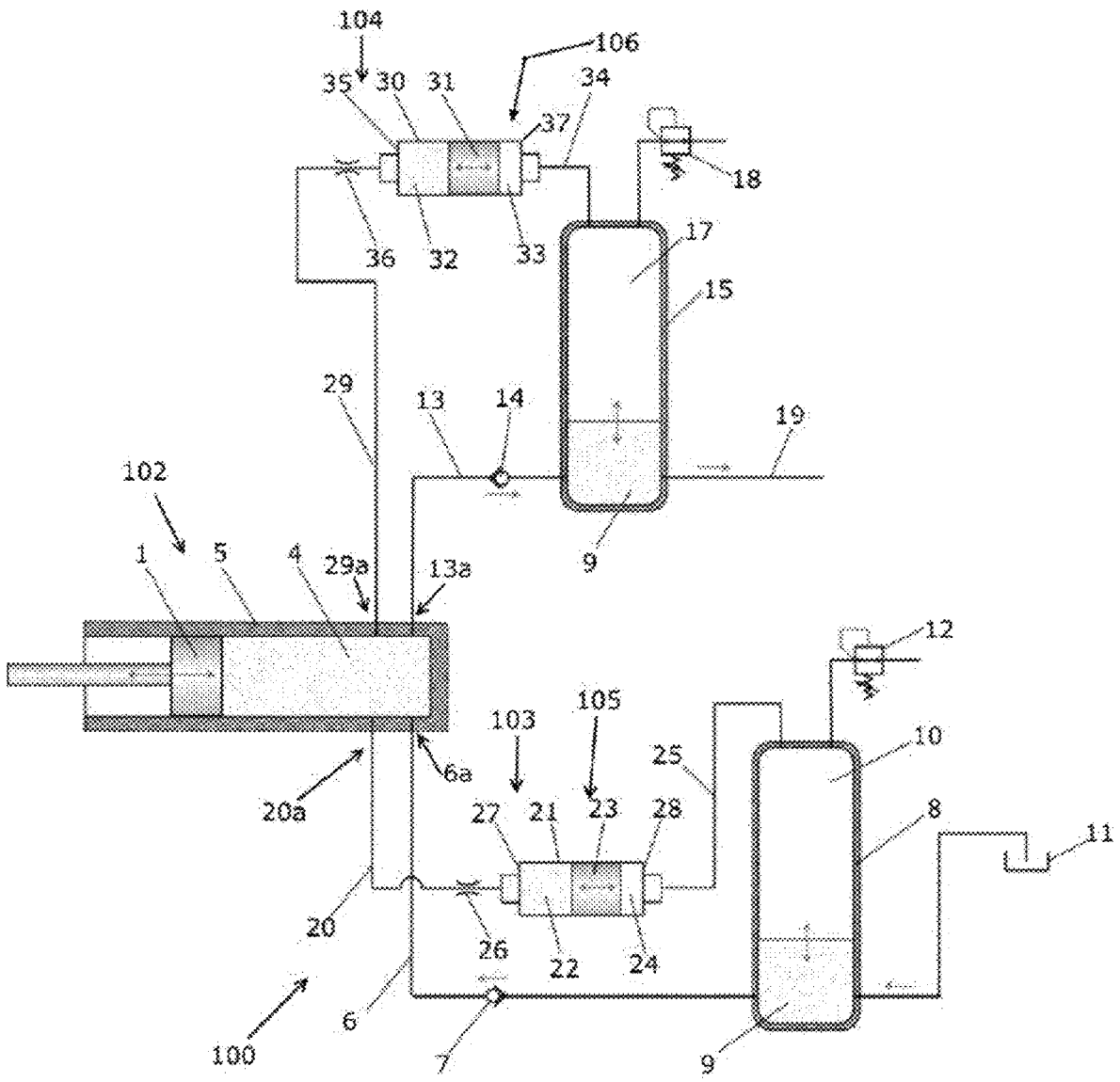
FIG. 4 shows a third embodiment of a pulsation damping system according to the present invention on a classic piston pump.

FIG. 4 shows an additional application of the pulsation damping system 100 on a conventional or classic piston pump 102, wherein the arrangement shown in the previous figures with the pipes 6, 13 connected to the pump 102, in particular the inlet line 6 and the outlet line 13 for the pressure medium 2*a* to be conveyed, along with the reservoirs 8 and 15 as temporary storage containers, which are advantageously arranged in each case for conveying a delivery need, are also shown here. With reference to FIG. 3, only the pump 102 is thus configured differently in FIG. 4. In this context, it should again be pointed out that the type of piston pump is of minor importance for the present invention.

With the present piston pump, the pressure medium 2*a* to be conveyed is directly used as the medium for damping the pressure pulsations arising in the pump conveyance chamber 4 and the inlet line 6 and outlet line 13. For this purpose, the pressure medium 2*a* can be conveyed not only through the inlet line 6 and outlet line 13 into or out of the pump conveyance chamber 4 but also via the hydraulic connection line 20 and 29 additionally connected to the pump conveyance chamber 4 via respectively one damping fluid connection 20*a*, 29*a*. In this case, in all other respects functionally identical to the arrangement according to FIG. 3, the pressure medium 2*a* in the pump conveyance chamber 4 is now, for damping purposes, additionally guided, depending on the mode of operation of piston 1, in particular suction or pressure operation, in the direction toward or away from the respective inlet-side and outlet-side damping device 103, 104, in particular through the throttle point 26, 36 arranged in the respective inlet line 6 and outlet line 13 for damping the pressure pulsations, in particular by converting the pressure energy into heat.

Figure 5:
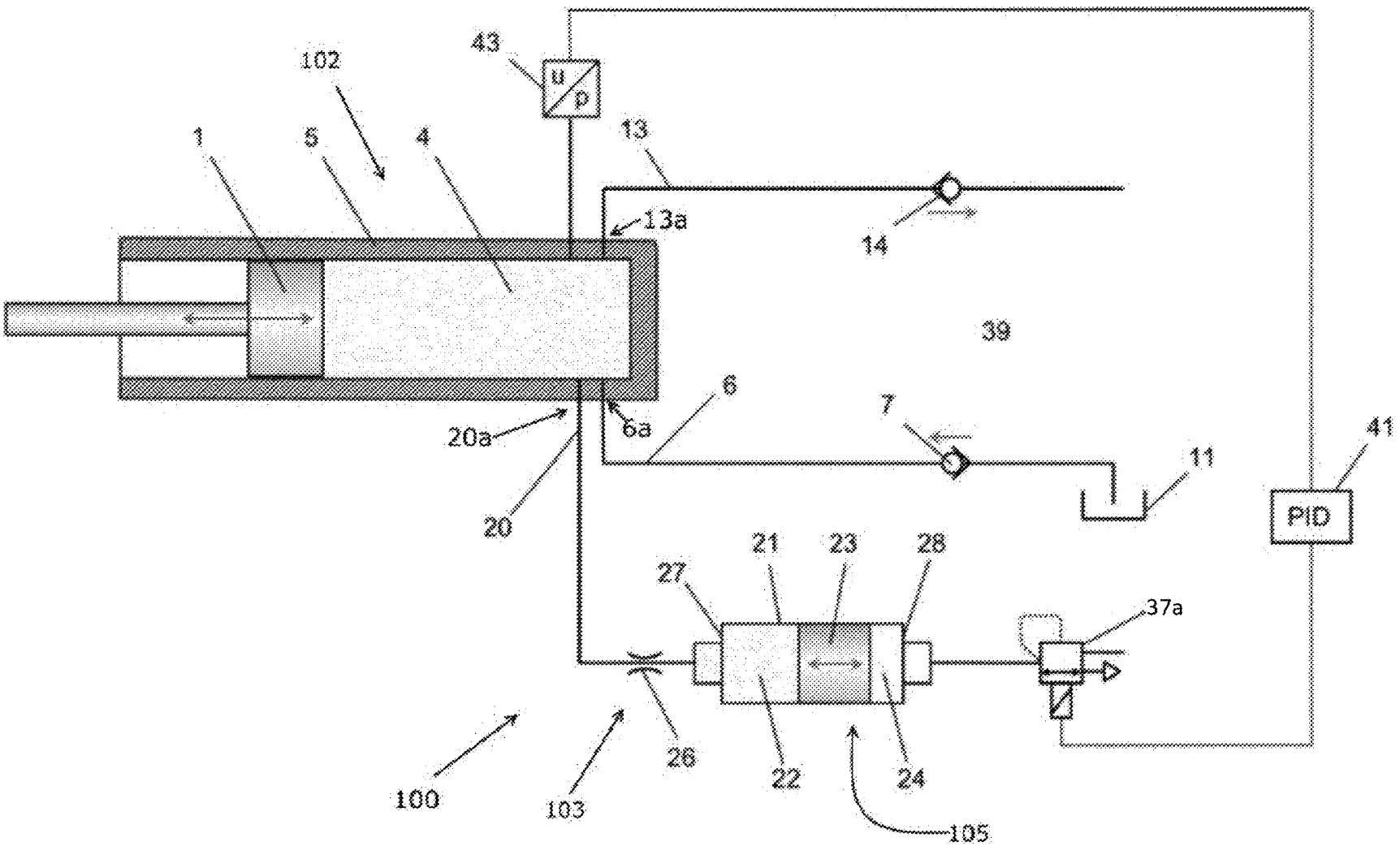
FIG. 5 shows a fourth embodiment of a pulsation damping system according to the present invention on a classic piston pump.
Figure 6:
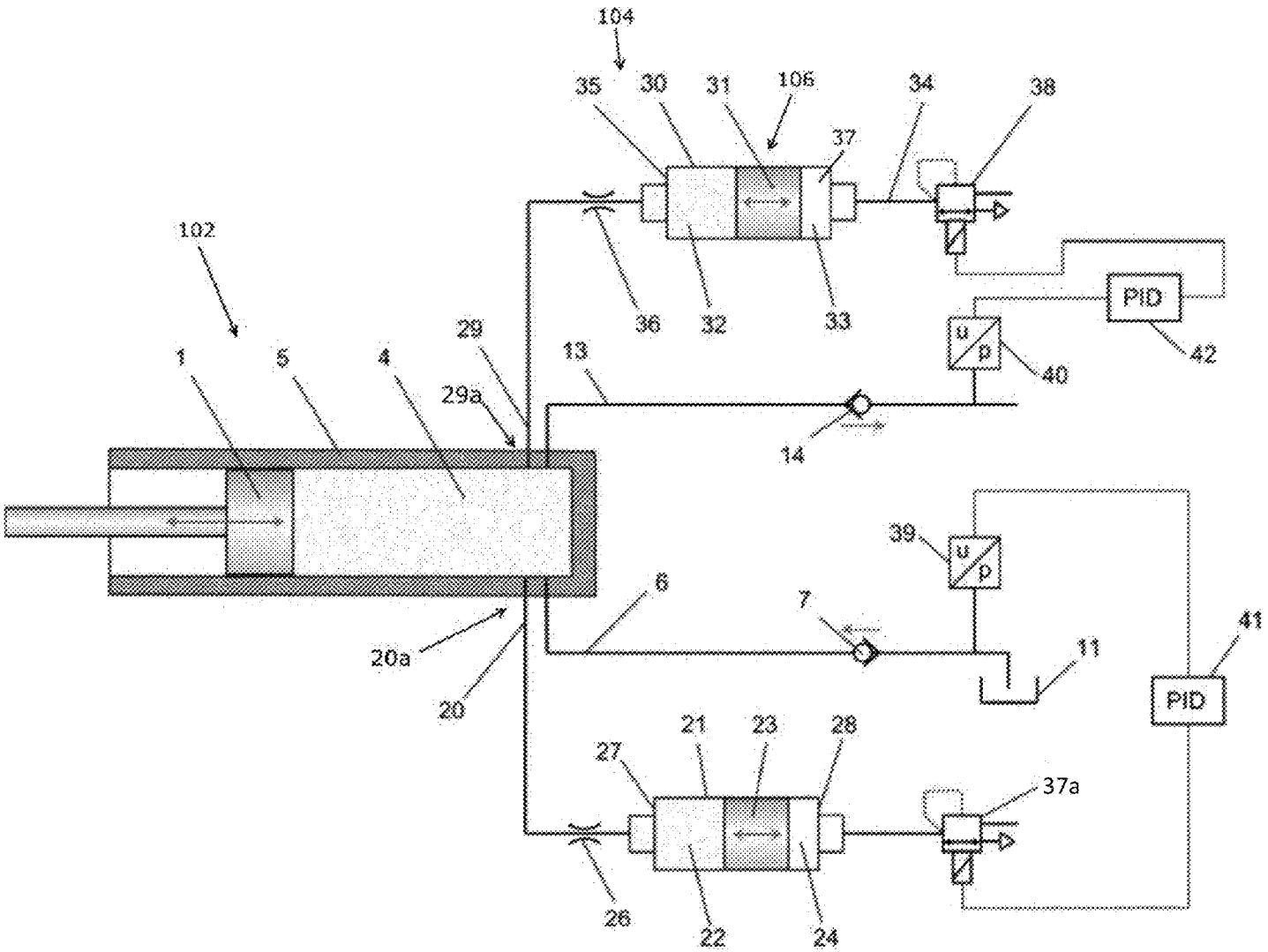
FIG. 6 shows an extended variant of the pulsation damping system of FIG. 5.

In FIGS. 5 and 6, an additional possible application of the pulsation damping system 100 is respectively shown. With some pump applications, the previously shown reservoir is dispensed with in the inlet line 6 and/or in the outlet line 13 or in both the inlet line 6 and the outlet line 13, as is to be shown in this example. Nevertheless, the principle of operation of the pulsation damping system 100 according to the present invention can also be used with such a pump arrangement. For this purpose, as shown in FIG. 5, the second pressure chamber 24 provided at the inlet-side volume change device 105 and, as shown in FIG. 6, additionally also the second pressure chamber 33 provided at the outlet-side volume change device 106 are each connected via a pressure line, pressure line 34 in FIG. 6, via a control valve 37*a*, 38 to an external compressed-air supply not shown. The gas pressure applied in the respective second pressure chamber 24, 33 can consequently be adjusted and regulated via the respective control valve 37, 38, in particular in order to adapt the respective pneumatic pressure in the second pressure chamber 24, 33 to the average pressures of the inlet line 6 or outlet line 13. For this purpose, the pressure in the respective inlet line 6, outlet line 13 can be determined by appropriate pressure sensors 39 and 40 as shown in FIG. 6 or by least one pressure sensor 43 directly on the pump conveyance chamber 4 as shown in FIG. 5 and can automatically be adjusted via control devices 41 or 42 in the second pressure chambers 24 and 33. In addition to the pressure regulation by means of pressure sensors/transducers and electronic controllers shown here, mechanical control valves, which convert the hydraulic pressure into a corresponding pneumatic pressure, are however also conceivable.

It should be clear that the scope of protection of the present invention is not limited to the described exemplary embodiments. The structure of the piston pump in particular and the main pipes that are connected thereto for conveying a fluid medium can certainly be modified, without changing the core of the present invention. For example, it is not absolutely necessary for reservoir 8 to be provided as a temporary storage container in the inlet line and/or for a reservoir 15 to be provided as a temporary container in the outlet line. Furthermore, the embodiment of the volume change devices 105, 106 can be of a different design; for example, a diaphragm can be provided instead of the separating piston 23, 31.

Figure 7:
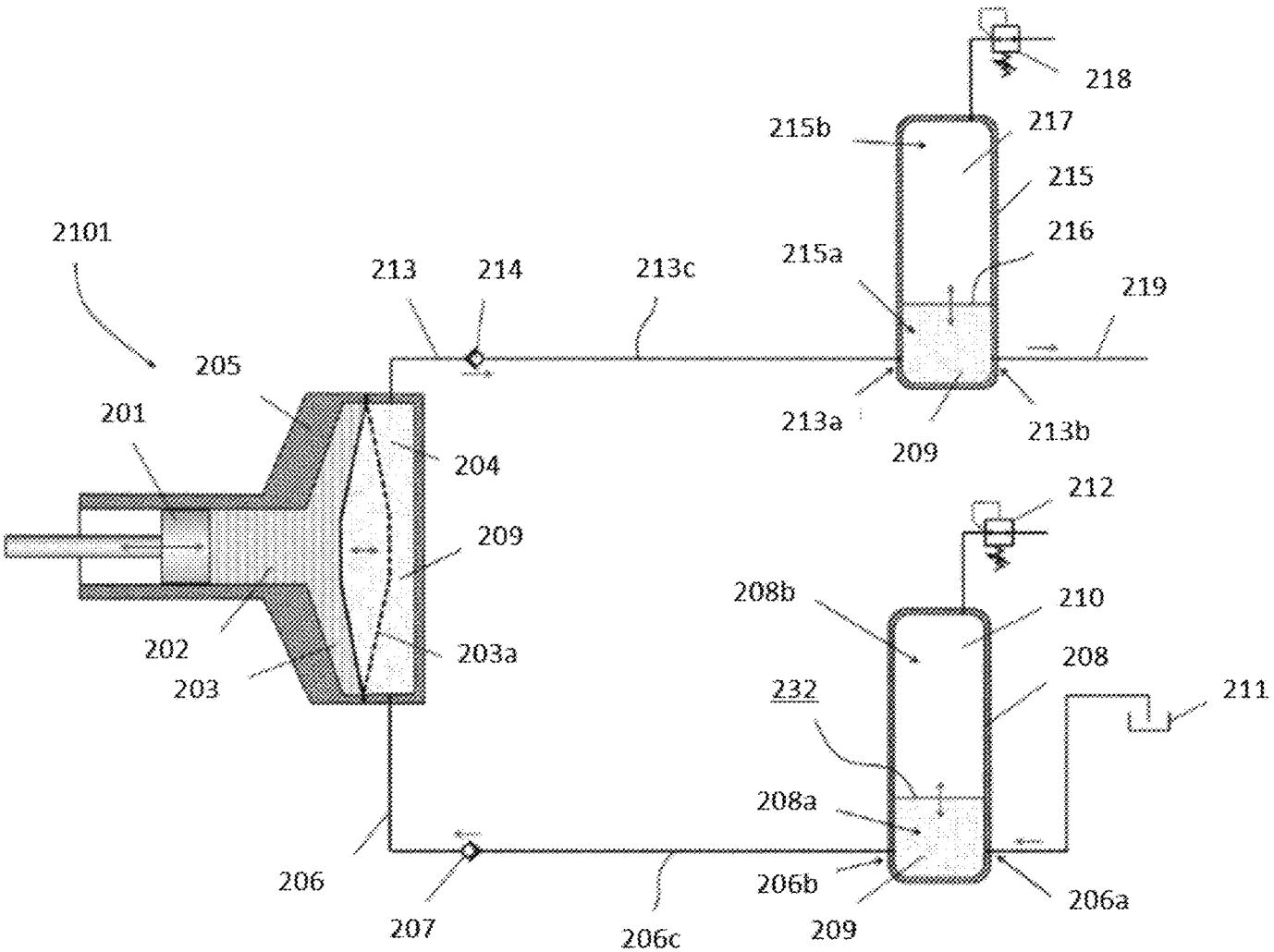
Fig. 7 (Prior Art)
FIG. 7 shows a piston diaphragm pump known from the prior art.

FIG. 7 shows the basic structure or a piston diaphragm pump 2101 known from the prior art with pipes 206, 213 connected thereto along with the first storage containers 208, 215, also called temporary containers or reservoirs, which are respectively advantageously arranged to convey a conveyance medium.

In this case, the oscillating movement of the piston 201 is transferred to a pressure medium located in a first pressure chamber 202 formed as a pump working chamber. This pressure medium is operatively connected via a flexible diaphragm 203 to the second pressure chamber 204, in the present case formed as a pump conveyance chamber, with respect to a pressure transfer. Both pressure chambers 202, 204 are surrounded by a pressure-resistant housing 205. In particular, the fluid 209 to be conveyed is located in the pump conveyance chamber 4; it can enter the pump conveyance chamber 4 from a pump inlet channel 206 via a fluid inlet and can exit from the pump conveyance chamber 4 through a fluid outlet into a pump outlet channel. In particular, the fluid 209 to be conveyed can be taken into the pump conveyance chamber 4 from the pump inlet channel 206, also known as the intake line, in which a suction valve 207 formed as a non-return valve is located.

In the arrangement from the prior art presented here, the first storage container 208 on the inlet side, also referred to as a reservoir, is additionally arranged in the inlet line 206 of the pump 2101 and is filled in a lower partial area 208*a* with the fluid 209 to be conveyed and in an upper partial area 208*b* with a gas 210 under pressure, for example compressed air. The lower partial area 208*a* of the first storage container 208 is fluidically connected to the pump inlet channel 206, in particular via a conveyance fluid inlet 206*a* facing a conveyance fluid source 211 not shown in detail, and via a conveyance fluid outlet 206*b* connected to a pipe section 206*c* of the pump inlet channel 206 connecting the first storage container 208 to the pump conveyance chamber 204. The conveyance fluid source 211 is typically a tank that has an increased geodetic height relative to the pump 2101 in order to be able to provide the required suction pressure. In principle, the lower partial area 208*a* and the upper partial area 208*b* of the first storage container 208 can be fluidically separated from one another by a displacement body formed as a diaphragm, for example. In the present case, the lower partial area 208*a* and the upper partial area 208*b* are separated due to the different arrangement and densities of the fluid 209 and the gas 210, which form a fill level height 232 at the separation surface, wherein the respective fill level height 232 in the first storage container 208 is controlled via the pressure of the gas 210. By measuring the fill level height 232 in the first storage container 208, the pressure of the gas 210 can be varied in particular via a control valve 212 in such a manner that a predetermined fill level height 232 in the first storage container 208 is compensated as precisely as possible. For adjusting or regulating the gas pressure prevailing in the first storage container 208, the inlet-side first storage container 208 is connected to a gas source (not shown) via a pneumatic or pressure line arranged in the area of the gas 210 and via the control valve 212. Alternatively, this inlet-side first storage container 208 can also be acted upon by so-called "feed pumps," not shown here, which then generate the necessary suction pressure in the inlet line 6.

In the outlet line 213 in which is located a pressure valve 214 formed as a non-return valve, a further outlet-side first storage container 215, likewise constructed as a reservoir, is arranged. The outlet-side first storage container 215, in particular a lower area 215*a* of the first storage container 215, is fluidically connected to the pump outlet channel 213, in particular via a conveyance fluid inlet 213*a* connected to a pipe section 213*c* of the pump outlet channel 213 connecting the pump conveyance chamber 204 to the outlet-side first storage container 215, and via a conveyance fluid outlet 213*b* connected to a conveyance fluid discharge line 219 not shown in detail.

Analogously to the suction side of the pump 2101, in particular to the first storage container 208 arranged thereon, the fluid 209 to be pumped is likewise located in the lower area 215*a* of the outlet-side first storage container 215, while a gas or air volume 217 under pressure is located in the upper area 215*b*. The lower area 215*a* and the upper area 215*b* are also not fluidically separated from each other by a separate separating means, such as a displacement body; rather, they are separated due to the different arrangement and densities of the fluid 209 and the gas volume 217, which form a fill level height 216 at the separation surface. Here as well, the fill level height 216 of the outlet-side first storage container 215 can be regulated via a control valve 218 that can be fluidically connected to the gas volume 217 and also a gas source that is connected thereto and is not shown in greater detail. Via the conveyance fluid discharge line 219, the volume flow of the fluid 209 generated by the pump 2101 can be supplied to an intended application, which is not shown.

The functionality of such a pump 2101 can be described as follows: During the suction phase of the piston pump 2101 shown, the piston 201 moves to the left from the rightmost position shown in FIG. 7, resulting in a drop in pressure in the pump working chamber 202. This pressure is transferred by the flexible diaphragm 203, which is located at the beginning of the suction phase in the position 203*a*, to the pump conveyance chamber 204, and thus to the fluid 209 to be conveyed. If the pressure in the two pressure chambers 202 and 204 of the pump 2101 falls below a pressure prevailing in the inlet line 206 and in the inlet-side first storage container 208, the suction valve 207 automatically opens and the fluid 209 to be conveyed flows from the inlet-side first storage container 208 into the pump conveyance chamber 204.

Once the piston 201 has reached the leftmost position shown in FIG. 7, it subsequently moves back to the right again. This results in the compression of the two pressure chambers 202 and 204. This pressure increase causes the suction valve 207 to open and no further fluid 209 to be sucked in. If the piston 201 now moves further to the right, the pressure in the two pressure chambers 202, 204 continues to rise until the pressure prevailing in the outlet line 213 and in the first storage container 215 is exceeded. As a result, the pressure valve 214 opens and the pump 2101 conveys the fluid 209 from the pump conveyance chamber 204 into the reservoir 215 until the piston 201 has again reached the rightmost position, and the process repeats.

The oscillating movement of the piston 201 exerts acceleration effects on the fluid medium 209 to be conveyed, which can lead to pulsations in the pressure chambers 202 and 204, the adjacent suction pipe 206, and the discharge pipe 213. In order to reduce these pulsations, the pulsation damper system 2100 according to the present invention is presented below, by means of which, above all, the pulsations that propagate when the fluid 209 is sucked in can be reduced.

Figure 8:
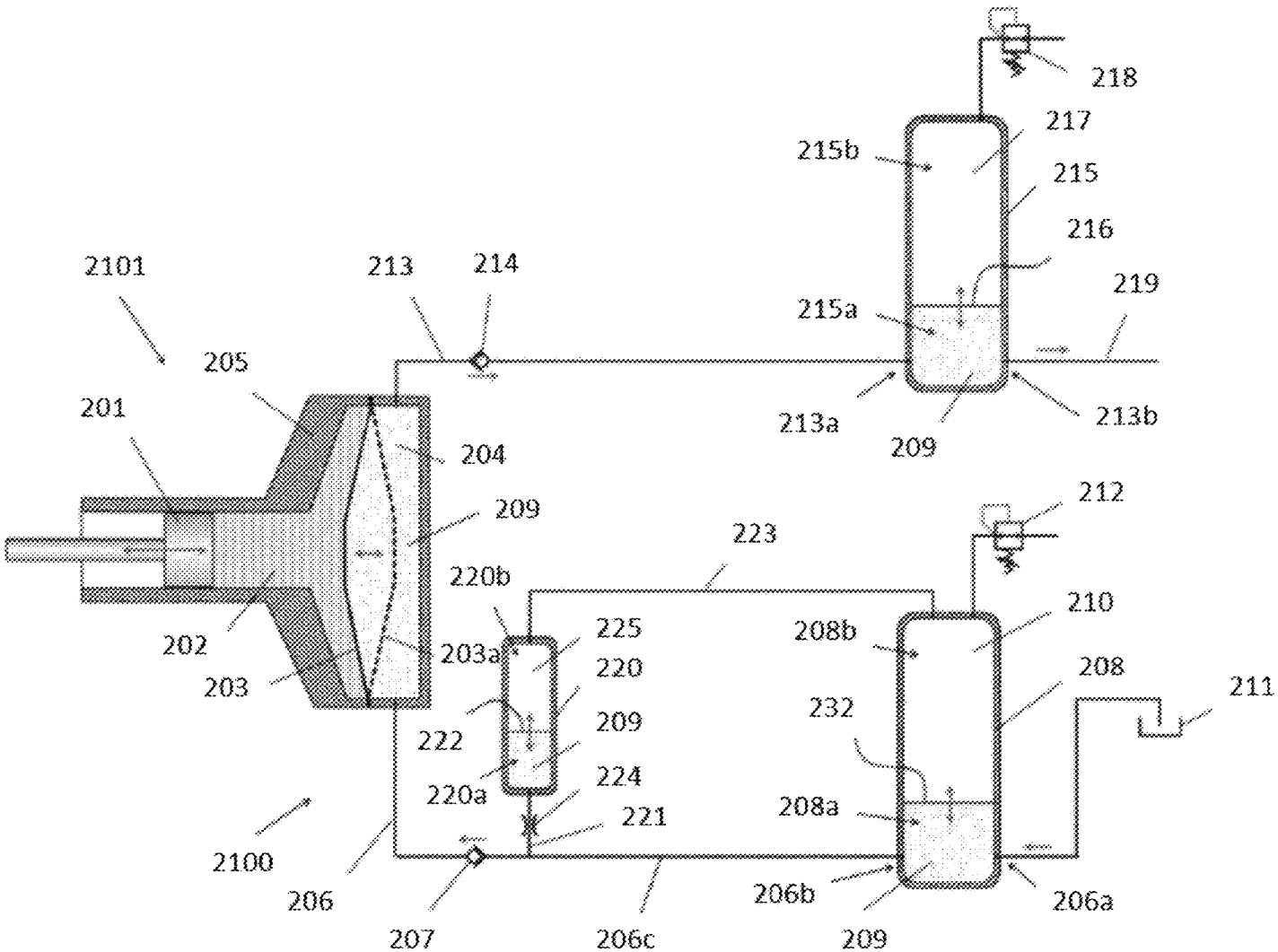
FIG. 8 shows a first embodiment of a pulsation damping system according to the present invention on a piston diaphragm pump.

FIG. 8 shows a first embodiment of the pulsation damping system 2100 according to the present invention. This embodiment additionally provides, for example, on the typical structure of a piston diaphragm pump system shown in FIG. 7, a second storage container 220 arranged on the pump inlet side. The second storage container 220 is also structured in the manner of a reservoir or pressure vessel and has a first (lower) area or first pressure chamber 220*a* and a second (upper) area or second pressure chamber 220*b*. The first area 220*a* in the present case of the inlet-side second storage container 220 is fluidically connected to the pump inlet channel 206 via a branch pipe 221 and filled with the fluid 209. In this case, the connection of the branch pipe 221 to the pump inlet channel 206 is in particular as close as possible to the pump conveyance chamber 204 but always before, i.e. upstream of, the non-return or suction valve 207 in the flow direction, in particular in the pipe section 206*c*. Due to this arrangement, in particular a portion of the fluid 209 contained in the pump inlet channel 206 can flow into and out of the first pressure chamber 220*a*.

A gas volume 225 is formed in the second (upper) area or second pressure chamber 220*b*, as in the case of the first storage container 208. The second pressure chamber 220*b* is connected via a pressure line 223 to the volume of the gas 210 of the first storage container 208 arranged on the inlet side so that an average pressure corresponding to the average pressure in the first storage container 208 is established in the second pressure chamber 220*b*. This leads in particular to the fact that, when the pump 2101 is at a standstill, an identical geodetic fill level height 222 is established in the inlet-side second storage container 220, which fill level height also prevails in the inlet-side first storage container 208.

If pressure pulsations now arise in the inlet line 6 of the pump 2101 during the operation of the pump 2101, they lead, when the pressure increases, to a volume flow of the fluid 209 to be pumped from the pump inlet channel 206 through the branch pipe 221 into the first pressure chamber 220*a* of the second storage container 220. In order to effectively damp the pulsations in the pump chambers 202 and 204 and the adjacent pump inlet channel 206 and pump outlet channel 213, a throttle point 224 is introduced into the branch pipe 221. Thus, when the throttle point 224 is flowed through, a portion of the pulsation energy is converted into heat and thus reduces the magnitude of the pressure pulsations. If the pressure in the pump inlet channel 206 is subsequently reduced, the pressure in the gas-filled second pressure chamber 220*b* leads to an increased counter-pressure and consequently to a displacement, in particular a lowering of the fill level height 222 and a volume flow of the fluid 209 from the first pressure chamber 220*a* into the pump inlet channel 206, wherein pressure energy is again converted into heat at the throttle point 224, and the pulsation is thus further reduced.

If compression arises in the pump conveyance chamber 204 after the end of the suction phase, the suction valve 207 in turn closes and the fluid 209 to be pumped is conveyed via the outlet line 213 into the outlet-side first storage container 215. In this case, a brief pressure reduction can arise in the suction pipe 206, as a result of which a portion of the fluid 209 can flow again from the second storage container 220 back into the intake line 206, wherein, in turn, hydraulic energy is converted into heat when the throttle 224 is flowed through and the pulsations are reduced further. The system can thus permanently convert pulsation energy into heat, in particular during the suction phase.

Since frictional losses and flow effects in the pump inlet channel 206 can lead to slightly different average pressures in the containers 208 and 220, different average geodetic fill level heights 222, 232 are usually formed in the containers 208, 220. In order to prevent the second storage container 220 from running empty or being overfilled, which would significantly impair the function of the damper, the regulation of the fill level height 232 in the first storage container 208 and the installation height and the size of the second storage container 220 are coordinated with one another.

The damper shown in FIG. 8 thus reduces the pulsations prevailing in the suction area of the pump 2101. Since comparable pulsations can also arise on the discharge side of the pump 2101, a second embodiment of the pulsation damping system 2100 is shown in FIG. 9, in which a pulsation damper for the pressure line is provided in addition to the suction damper.

Figure 9:
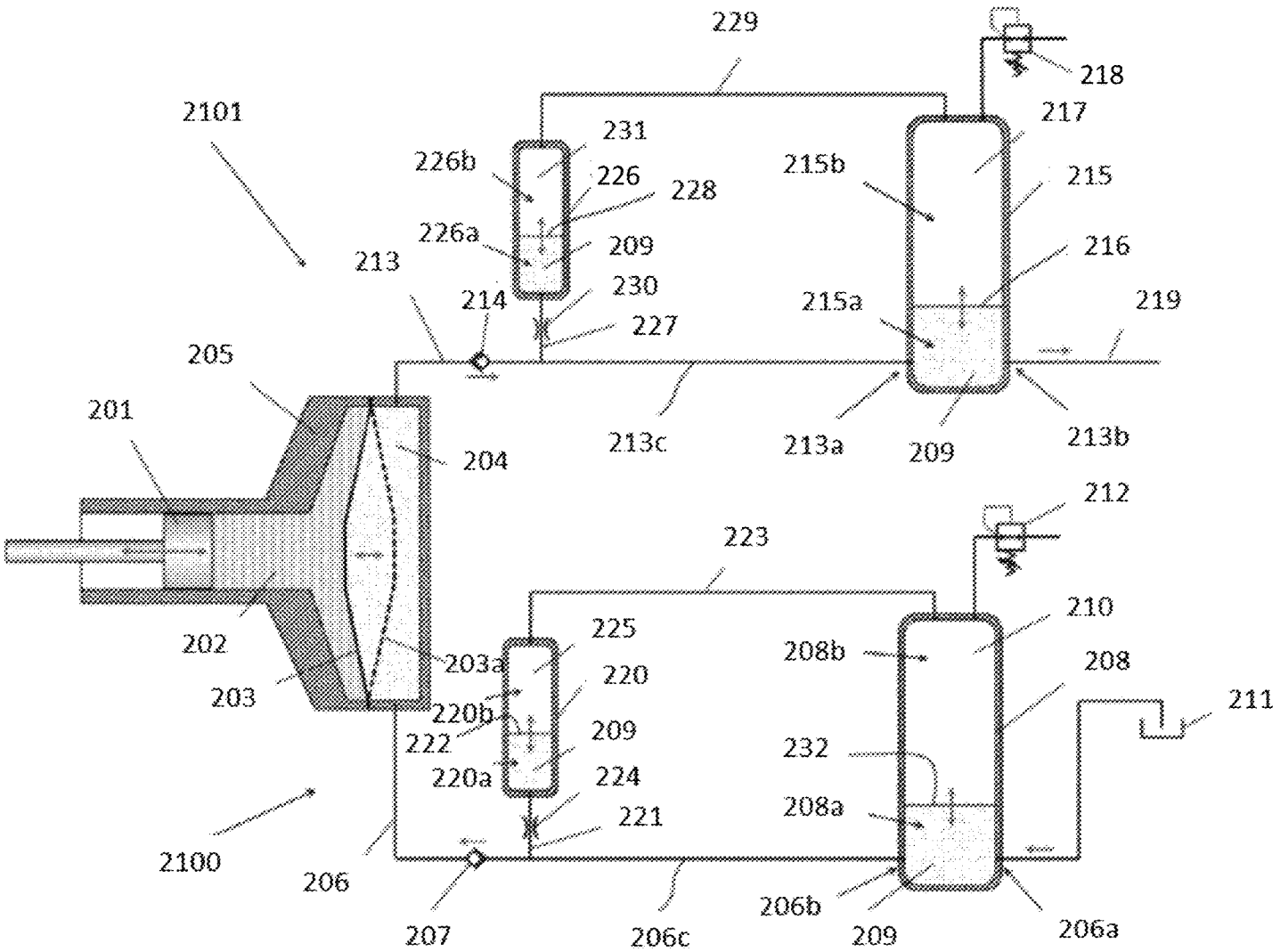
FIG. 9 shows a second embodiment of a pulsation damping system according to the present invention on a piston diaphragm pump.

In the arrangement shown in FIG. 9, the pulsation damping system 2100 according to FIG. 8 is additionally extended by a second storage container 226 located on the discharge side of the pump 2101 along with a throttle valve 230 as a throttle in the inlet line to this second storage container 226. Analogously to the arrangement of the second storage container 220 on the suction side, the pressure pulsation energy is also converted into heat in the arrangement on the discharge side as the fluid 209 flows through the throttle 230. Assumptions and conditions comparable with those for the intake-side damper also apply here. The structure and functionality of the outlet-side second storage container 226 along with its integration into the outlet-side pipe system therefore substantially corresponds to the arrangement of the second storage container 220 on the pump inlet side.

In the outlet-side second storage container 226 in turn, a lower area or first pressure chamber 226*a* filled with the fluid 209 is formed in a lower part and an upper area or second pressure chamber 226*b* filled with a gas volume 231 is formed in an upper part. The lower area 226*a* is fluidically connected to the pump outlet channel 213 via a branch pipe 227. In this case, the connection of the branch pipe 227 to the pump outlet channel 213 is arranged as close as possible to the pump conveyance chamber 204 but always downstream of the non-return or pressure valve 214 in the flow direction, in particular in the area of the pipe section 213*c*. Due to this arrangement, in particular a portion of the fluid 209 contained in the pump outlet channel 213 can flow into and out of the first pressure chamber 226*a*.

In the second pressure chamber 226*b*, a gas volume 231 is formed as in the first storage container 208 on the inlet side. The second pressure chamber 220*b* is connected via a pressure line 229 to the gas volume 217 of the first storage container 215 arranged on the outlet side so that an average pressure corresponding to the average pressure in the first storage container 215 is established in the second pressure chamber 226*b*. This leads in particular to the fact that, when the pump is at a standstill, an identical geodetic fill level height 228 is established in the outlet-side second storage container 226, which fill level height also prevails in the outlet-side first storage container 215. If pressure pulsations now arise in the high-pressure outlet line 213 of the pump 2101 during the operation of the pump, this pressure increase leads to the inflow of the fluid 209 to be pumped out of the outlet line 213 into the second storage container 226. In this case, once again, if the throttle 230 is flowed through, a portion of the pulsation energy can be converted into heat and pressure pulsations can thereby be reduced. If the pressure in the pump outlet channel 213 is subsequently reduced, the pressure in the gas-filled second pressure chamber 226*b* leads to an increased counter-pressure and consequently to a displacement, in particular a lowering of the fill level height 228 and a volume flow of the fluid 209 from the first pressure chamber 226*a* into the pump outlet channel 213, wherein pressure energy is again converted into heat at the throttle 230, and the pulsation is thus further reduced.

This system can thus permanently convert pulsation energy into heat not only during the suction phase but also during the pressure phase.

It should be clear that the embodiments of a respective pump with only one piston described here arise in practice only relatively infrequently, and in the present case are only intended to show the principle of operation of this type of pumps. Typically, pumps with a plurality of pistons are used; these draw in from a common intake line with a central reservoir and again convey into a common conveying line. The principles for position damping presented here can therefore be applied to pumps having any desired number of pistons. Furthermore, it also does not necessarily have to be a diaphragm pump; the pulsation damping system is also applicable to other pumps, for example classic piston pumps.

Furthermore, it should be clear that the scope of protection of the present invention is not limited to the described exemplary embodiments. The structure of the piston pump in particular and the main pipes that are connected thereto for conveying a fluid medium can certainly be modified, without changing the core of the present invention. For example, it is not absolutely necessary for the first storage container to be fluidically connected to the second storage container. Furthermore, the embodiment of the first and second storage containers can have a different design; for example, instead of the diaphragm arranged therein, a partition wall or a separating piston can be formed. Reference should be had to the appended claims.

LIST OF REFERENCE NUMERALS

1 Piston
2 Pump working chamber, pump chamber, (first) pressure chamber
2*a* Pressure medium, fluid, hydraulic oil
3, 3*a* Diaphragm
4 Pump conveyance chamber, pump chamber, (second) pressure chamber
5 Housing
6 Pump inlet channel, inlet line
6*a* Fluid inlet
7 Non-return valve, suction valve
8 Reservoir, storage container
8*a* Conveyance fluid inlet
8*b* Conveyance fluid outlet
9 Medium, fluid
10 Gas
11 Source
12 Control valve
13 Pump outlet channel, outlet line
13*a* Fluid outlet
14 Non-return valve, pressure valve
15 Reservoir, storage container
15*a* Conveyance fluid inlet
15*b* Conveyance fluid outlet
17 Gas, compressed air, gas volume
18 Control valve
19 Discharge line
20 Hydraulic connection line
20*a* Damping fluid connection
21 Cylinder
22 First pressure chamber
23 Separating piston
24 Second pressure chamber
25 Pipe, gas pressure line
26 Throttle point, throttle valve
27 First stop
28 Second stop
29 Hydraulic connection line
29*a* Damping fluid connection
30 Cylinder
31 Separating piston
32 First pressure chamber
33 Second pressure chamber
34 Pressure line
35 First stop
36 Throttle point, throttle
37 Second stop
37*a* Control valve
38 Control valve
39 Pressure sensor
40 Pressure sensor
41 Control device
42 Control device
43 Pressure sensor
100 Pulsation damping system
101 Piston diaphragm pump
102 Piston pump
103 (Inlet-side) Damping device
104 (Outlet-side) Damping device
105 (Inlet-side) Volume change device
106 (Outlet-side) Volume change device
201 Piston
202 Pump working chamber, pump chamber, (first) pressure chamber
203, 203*a* Diaphragm
204 Pump conveyance chamber, pump chamber, (second) pressure
chamber
205 Housing
206 Pump inlet channel, inlet line
206*a* Fluid inlet
206*b* Fluid outlet
206*c* Pipe section
207 Non-return valve, suction valve
208 First (inlet-side) storage container, temporary container, reservoir
208*a* Lower partial area
208*b* Upper partial area
209 Fluid medium, fluid
210 Gas, compressed air, gas volume, air volume
211 Fluid source
212 Control valve
213 Pump outlet channel, outlet line
213*a* Fluid inlet
213*b* Fluid outlet
213*c* Pipe section
214 Non-return valve, pressure valve
215 First (outlet-side) storage container, temporary container, reservoir
215*a* Lower area
215*b* Upper area
216 Fill level height
217 Gas, compressed air, gas volume, air volume
218 Control valve
219 Conveyance fluid discharge line
220 (Inlet-side) Second storage container, pressure vessel
220*a* First (lower) area, first pressure chamber
220*b* Second (upper) area, second pressure chamber
221 Branch pipe
222 Fill level height
223 Auxiliary pipe, pressure line
224 Throttle valve, throttle

225 Gas, compressed air, gas volume
226 (Outlet-side) Second storage container, pressure vessel
226*a* Lower area, first pressure chamber
226*b* Upper area, second pressure chamber
227 Branch pipe
228 Fill level height
229 Auxiliary pipe, pressure line
230 Throttle valve, throttle
231 Gas, compressed air, gas volume
232 Fill level height
2100 Pulsation damping system
2101 Piston pump, piston diaphragm pump

What is claimed is:

1. A pulsation damping system for reducing pressure oscillations in at least one of an inlet line and an outlet line of at least one piston pump, the at least one piston pump comprising a pump chamber which is connected to the inlet line of the at least one piston pump via a first fluid connection and to the outlet line of the at least one piston pump via a second fluid connection so as to convey a conveyance fluid, the pulsation damping system comprising:

a damping device;

a hydraulic connection line arranged between the pump chamber and the damping device; and a throttle valve arranged in the hydraulic connection line, wherein, the pump chamber comprises at least one damping fluid connection via which the pump chamber is fluidically connected to the damping device so as to damp the pressure oscillations in the at least one of the inlet line and the outlet line of the at least one piston pump, and the damping device is at least one of directly and indirectly operatively connected to the inlet line via a pressure line, the pressure line being separate from the hydraulic connection line, so as to regulate a gas pressure prevailing in the damping device.

2. The pulsation damping system as recited in claim 1, wherein, the at least one piston pump is provided as a piston diaphragm pump, the pump chamber of the at least one piston pump comprises a pump working chamber and a pump conveyance chamber which is fluidically separated from and operatively connected to the pump working chamber, the first fluid connection and the second fluid connection are arranged on the pump conveyance chamber, and the at least one damping fluid connection is arranged on the pump working chamber.

3. A pulsation damping system for reducing pressure oscillations in at least one of inlet line and in an outlet line of at least one piston pump, the at least one piston pump comprising a pump chamber which is connected to the inlet line of the at least one piston pump via a first fluid connection and to the outlet line of the at least one piston pump via a second fluid connection so as to convey a conveyance fluid, the pulsation damping system comprising:

a damping device which comprises a displacement body which is provided as a displaceable wall, as a displaceable piston, or as a displaceable diaphragm; and at least one pressure chamber which is fluidically connected to the pump chamber, wherein, the pump chamber comprises at least one damping fluid connection via which the pump chamber is fluidically connected to the damping device so as to damp the pressure oscillations in the at least one of the inlet line and the outlet line of the at least one piston pump, the displacement body of the damping device is configured to change a volume of the at least one pressure chamber, the at least one pressure chamber is provided as a first pressure chamber which is fluidically connected to the pump chamber, and a second pressure chamber which is fluidically separated from the first pressure chamber via the displacement body, the first pressure chamber being operatively connected to the second pressure chamber, a reservoir is arranged in at least one of the inlet line and in the outlet line, the reservoir comprising a conveyance fluid inlet and a conveyance fluid outlet, the conveyance fluid being temporarily storable in a lower area of the reservoir, and a gas volume being arranged in an upper area of the reservoir, and the gas volume of the reservoir is fluidically connected to the second pressure chamber of the damping device.

4. The pulsation damping system as recited in claim 3, wherein, the at least one piston pump is provided as a piston diaphragm pump, the pump chamber of the at least one piston pump comprises a pump working chamber and a pump conveyance chamber which is fluidically separated from and operatively connected to the pump working chamber, the first fluid connection and the second fluid connection are arranged on the pump conveyance chamber, and the at least one damping fluid connection is arranged on the pump working chamber.

* * * * *